US012538978B2

(12) United States Patent
Kaicker et al.

(10) Patent No.: US 12,538,978 B2
(45) Date of Patent: Feb. 3, 2026

(54) COSMETICS BRUSH HOLDER

(71) Applicant: Anisa International, Inc., Atlanta, GA (US)

(72) Inventors: Anisa Telwar Kaicker, Atlanta, GA (US); Shuai Chen, Atlanta, GA (US)

(73) Assignee: Anisa International, Inc., Atlanta, GA (US)

( * ) Notice: Subject to any disclaimer, the term of this patent is extended or adjusted under 35 U.S.C. 154(b) by 471 days.

(21) Appl. No.: 17/984,839

(22) Filed: Nov. 10, 2022

(65) Prior Publication Data

US 2023/0147483 A1 May 11, 2023

Related U.S. Application Data

(60) Provisional application No. 63/278,333, filed on Nov. 11, 2021.

(51) Int. Cl.
*A46B 17/02* (2006.01)

(52) U.S. Cl.
CPC ..... *A46B 17/02* (2013.01); *A46B 2200/1046* (2013.01)

(58) Field of Classification Search
CPC .. A47K 5/18; A47K 1/09; A47G 29/08; A47L 13/512; A46B 17/02; Y10T 24/1394
USPC ..... 248/229.26; 220/710; D6/534, 535
See application file for complete search history.

(56) References Cited

U.S. PATENT DOCUMENTS 1,286,014 A * 11/1918 Name not available ..... A47L 13/512 248/113
1,424,434 A 8/1922 Herman
1,643,661 A * 9/1927 Kendall ..... A47J 43/287 248/113
D154,689 S * 8/1949 Lundgren ..... 206/362.1
2,533,354 A 12/1950 Comfort
2,555,053 A 5/1951 Myrick et al.
2,807,431 A * 9/1957 Mchale ..... B44D 3/123 248/113

(Continued)

FOREIGN PATENT DOCUMENTS

CN 2099541 3/1992
CN 201996424 10/2011

(Continued)

OTHER PUBLICATIONS

Kaicker, Anisa Telwar, Notice of Allowance for Design U.S. Appl. No. 29/734,568, filed May 13, 2020, mailed Sep. 16, 2021, 13 pgs.

(Continued)

*Primary Examiner* — Joel D Crandall
(74) *Attorney, Agent, or Firm* — Taylor Duma LLP

(57) ABSTRACT

A cosmetics brush holder includes a holder base defined at a lower end of the cosmetics brush holder, the holder base defining an inner base surface and an outer base surface opposite the inner base surface; and a holder sidewall defining an undulating pattern about a circumference of the holder sidewall, the holder sidewall defining an inner sidewall surface and an outer sidewall surface opposite the inner sidewall surface, the inner sidewall surface defining a plurality of alternating inner sidewall grooves and inner sidewall ridges; and an interior cavity defined by the inner base surface and the inner sidewall surface and configured to receive cosmetics brushes.

21 Claims, 8 Drawing Sheets

(56) References Cited

U.S. PATENT DOCUMENTS 3,121,507 A * 2/1964 Weiss ..... B65D 1/36 229/116.2
D206,156 S 11/1966 Shinker
3,442,420 A * 5/1969 Edwards ..... B65D 1/265 206/520
3,784,052 A * 1/1974 Edwards ..... B65D 1/265 206/520
3,880,281 A * 4/1975 Taddei ..... A46B 11/0089 206/217
D241,314 S 9/1976 Hug et al.
D279,851 S 7/1985 Willis
D292,309 S 10/1987 Baron
4,884,701 A 12/1989 Nymark et al.
4,947,998 A * 8/1990 Smeller ..... A47G 25/12 211/70.6
5,016,773 A 5/1991 Lockwood
D340,161 S * 10/1993 Regidor ..... D6/528
D342,636 S * 12/1993 Booth ..... D6/534
5,332,090 A * 7/1994 Tucker ..... A63B 55/408 248/314
D358,691 S * 5/1995 Engle ..... D32/54
5,484,065 A * 1/1996 Davoli, Jr. ..... A47K 1/09 215/390
5,544,783 A * 8/1996 Conigliaro ..... B65D 83/303 D9/434
D375,453 S * 11/1996 Fleck ..... D8/395
5,609,259 A 3/1997 Menard
5,775,570 A * 7/1998 Kim ..... B65D 21/0208 206/217
5,820,090 A 10/1998 Nickels
D404,285 S 1/1999 Skudelny
D408,272 S 4/1999 Caron et al.
5,947,322 A 9/1999 Ho
D431,337 S * 9/2000 King ..... D32/54
6,202,963 B1 * 3/2001 Derman ..... A46B 17/02 248/682
D440,089 S * 4/2001 Lillelund ..... D6/524
D440,090 S 4/2001 Lillelund et al.
6,419,194 B1 7/2002 Losacco et al.
6,497,236 B1 12/2002 Yates et al.
D470,937 S 2/2003 Gary et al.
D498,793 S 11/2004 Stoddard et al.
6,866,166 B2 3/2005 Mehes et al.
6,926,151 B1 8/2005 Perry et al.
D510,822 S 10/2005 Spiers et al.
D515,406 S 2/2006 Groff et al.
7,188,629 B2 3/2007 Mehes et al.
D560,482 S 1/2008 Casteel et al.
D578,869 S 10/2008 Fernandez
D622,469 S * 8/2010 Nacey ..... D32/54
D648,211 S 11/2011 Weaver et al.
D666,026 S 8/2012 Alvarez et al.
8,336,721 B2 12/2012 Traldi
D682,464 S 5/2013 Gary et al.
D690,997 S 10/2013 Zemel et al.
D702,531 S 4/2014 Eddisford
8,777,170 B2 * 7/2014 Gilbert ..... A47F 7/00 24/3.12
D720,612 S * 1/2015 Gilbert ..... D8/394
9,010,708 B2 * 4/2015 Vasilev ..... A47K 1/09 248/539
D729,542 S 5/2015 Dontfraid
9,314,315 B2 4/2016 Wong
D765,449 S 9/2016 Buller
D773,287 S 12/2016 Lida
D775,534 S 1/2017 Turksu et al.
9,538,871 B2 1/2017 Renkola
D836,431 S 12/2018 Frost
D850,811 S 6/2019 Alluigi
10,479,564 B2 11/2019 Li et al.
D875,406 S 2/2020 Dixon
D877,485 S 3/2020 Rampersaud
D884,280 S 5/2020 Pellereau et al.
D886,991 S 6/2020 Kindler et al.
D899,223 S 10/2020 Landgren
D904,090 S 12/2020 Yang et al.
D937,020 S 11/2021 Kaicker et al.
2007/0170188 A1 * 7/2007 Guillaume ..... A47G 19/2266 220/710
2011/0031152 A1 * 2/2011 Petlak ..... B65D 1/34 206/503
2012/0205389 A1 * 8/2012 Beary ..... A47G 19/2222 220/710
2017/0253363 A1 * 9/2017 Feeley ..... A47G 19/02

FOREIGN PATENT DOCUMENTS

CN 202458128 10/2012
CN 203328605 12/2013
CN 303176398 4/2015
CN 104757895 7/2015
CN 303778100 8/2016
CN 304761199 8/2018
CN 304778658 8/2018
CN 304954741 12/2018
CN 209915820 1/2020
EP 200050073-0001 5/2001
EP 1849623 10/2007
EP 003055078-0001 4/2016
EP 003070788-0001 4/2016
EP 3031354 6/2016
JP 5724829 5/2015
JP 5960406 8/2016
KR 20100010834 11/2010
WO 2008104625 9/2008
WO 2020161639 8/2020

OTHER PUBLICATIONS

AMAZON; Article entitled: "Levilan Champagne Gold Glass Brush Holder Makeup Organizer Vintage Brass Edge Cosmetic Organizer Makeup Decoration Make up Brushes Holder(Geometry)", available at <https://www.amazon.com/ dp/B07G323VC8/ref=sspa_dk_detail_9?psc=1&pd_rd_i=B07G323VC8&pd_rd_w=QpSA7&pf_rd_p=48d372c1-7e1-4b8b-9d%E2%80%A6>, accessed on May 4, 2020, 6 pgs.

AMAZON; Article entitled: "LORMAY Silicone Makeup Brush Organizer + Makeup Brush Cleaning Mat—Brush Holder for Air Drying", available at <https://www.amazon.com/LORMAY-Organizer-Cleaning-Container-Accessories-Makeup/dp/B07G5TLMFG/ref=cm_cr_arp_d_product_top?ie=UTF8>, accessed on May 4, 2020, 6 pgs.

PINTEREST; Article entitled: "40 Creative and Beautiful Examples of Ceramic Arts—Bored Art", located at <https://in.pinterest.com/pin/413346072046115581/>, accessed on Jun. 7, 2021, 3 pgs.

PINTEREST; Article entitled: "Taking Care of Your Teeth, Does Not Have to Be Difficult—Oral Health Care" available at <https://in.pinterest.com/pin/148759593928829243/>, accessed on Jun. 7, 2021, 3 pgs.

* cited by examiner

COSMETICS BRUSH HOLDER

CROSS-REFERENCE TO RELATED APPLICATIONS

The present application claims the benefit of U.S. Provisional Application No. 63/278,333, filed Nov. 11, 2021, which is hereby specifically incorporated by reference herein in its entirety.

TECHNICAL FIELD

This disclosure relates to cosmetics devices. More specifically, this disclosure relates to a cosmetics holder for holding cosmetics brushes and other tools.

BACKGROUND

Often, cosmetics brush holders comprise a substantially flat base and a substantially cylindrical sidewall extending upward from the flat base. Cosmetics brushes can be disposed within an interior cavity of the brush holder. However, cosmetics brushes cannot be supported by the brush holder outside of the interior cavity. Additionally, because of the flat base and the cylindrical sidewall, cosmetics brushes received in the interior cavity often cluster together at one side of the interior cavity, limiting air flow between brushes and making it difficult for wet brushes to properly dry.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is cosmetics brush holder comprising a holder body, the holder body defining a holder base and a holder sidewall, the holder sidewall defining an inner sidewall surface and an outer sidewall surface; and a brush retainer extending outward from the outer sidewall surface of the holder sidewall, the brush retainer configured to secure a cosmetics brush to the holder body.

Also disclosed is a cosmetics brush holder comprising a holder base defined at a lower end of the cosmetics brush holder, the holder base defining an inner base surface and an outer base surface opposite the inner base surface; and a holder sidewall defining an undulating pattern about a circumference of the holder sidewall, the holder sidewall defining an inner sidewall surface and an outer sidewall surface opposite the inner sidewall surface, the inner sidewall surface defining a plurality of alternating inner sidewall grooves and inner sidewall ridges; and an interior cavity defined by the inner base surface and the inner sidewall surface and configured to receive cosmetics brushes.

Additionally, disclosed is a cosmetics brush holder comprising a holder body, the holder body defining a holder base and a holder sidewall, the holder sidewall extending from the holder base and defining an inner sidewall surface and an outer sidewall surface opposite the inner sidewall surface, the holder base defining an inner base surface and an outer base surface opposite the inner base surface; an interior cavity defined by the inner base surface and the inner sidewall surface and configured to receive a first cosmetics brush; and a brush retainer extending outward from the outer sidewall surface of the holder sidewall, the brush retainer configured to secure a second cosmetics brush to the holder body external to the interior cavity.

A cosmetics brush retaining clip is also disclosed, the cosmetics brush retaining clip comprising a clip portion defining a handle channel, the handle channel configured to receive a handle of a cosmetics brush; a mounting portion comprising a mounting tab and a mounting shoulder, the mounting shoulder extending between the clip portion and the mounting tab; and a mounting slot defined between the clip portion and the mounting tab, the mounting slot configured to receive an edge of an object to mount the cosmetics brush retaining clip to the object Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
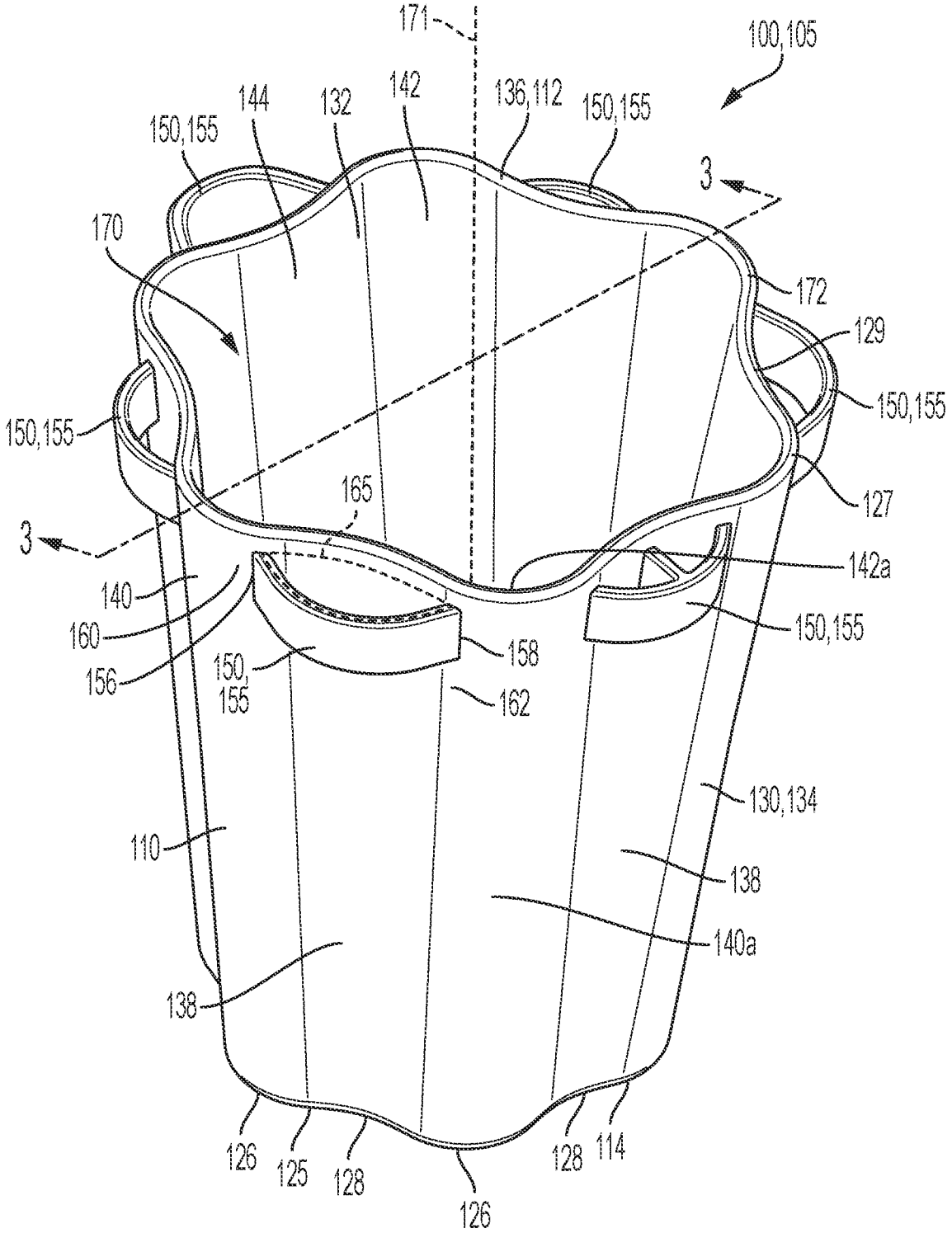
FIG. 1 is a perspective view of a cosmetics brush holder, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a cosmetics brush holder and associated methods, systems, devices, and various apparatus. Example aspects of the cosmetics brush holder can comprise holder body and a brush retainer coupled to the holder body. It would be understood by one of skill in the art that the cosmetics brush holder is described in but a few exemplary embodiments among many. No particular terminology or description should be considered limiting on the disclosure or the scope of any claims issuing therefrom.

Figure 2:
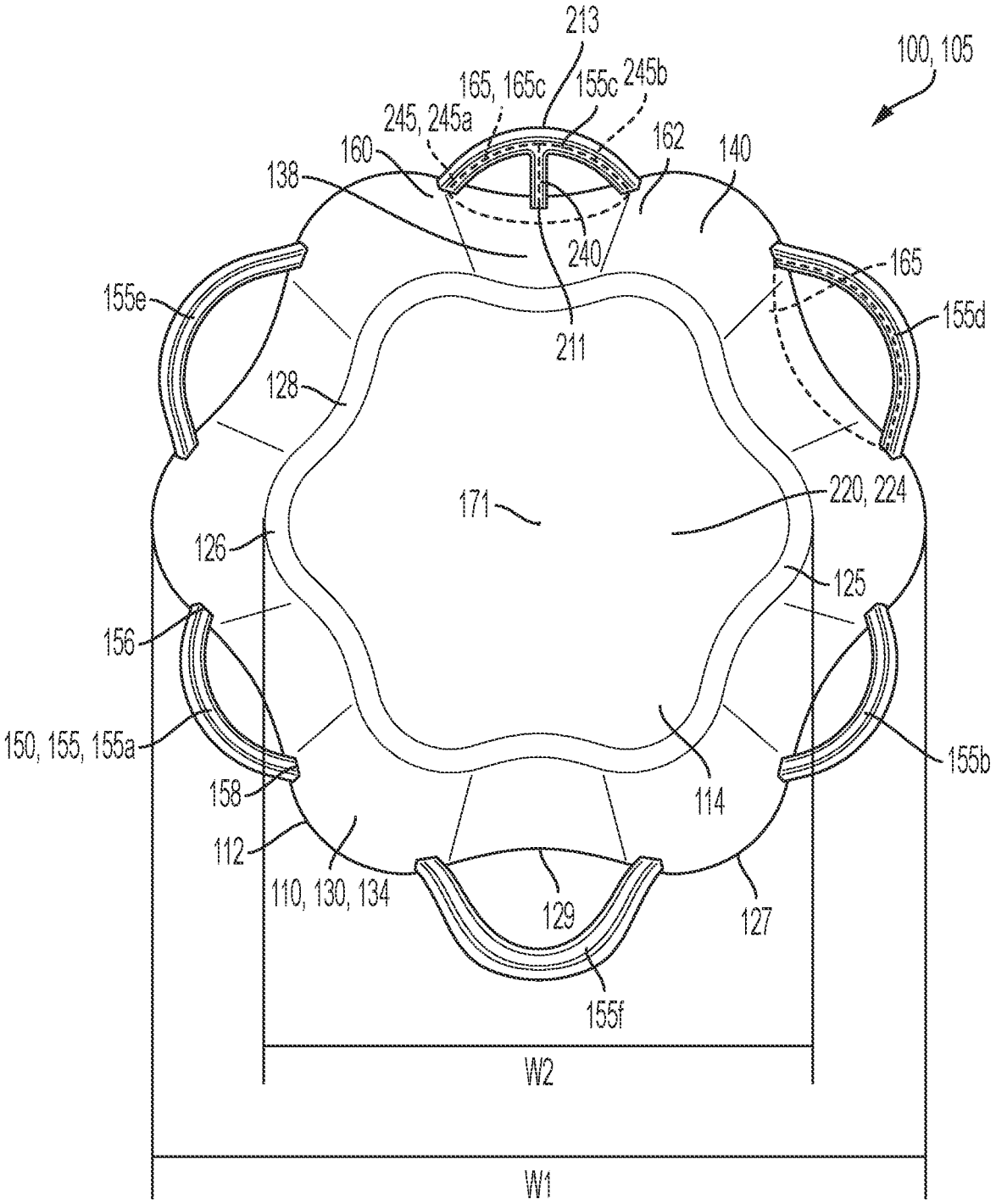
FIG. 2 is a bottom view of the cosmetics brush holder of FIG. 1.

FIGS. 1 and 2 illustrate a perspective view and a bottom view, respectively, of a cosmetics brush holder 100, in accordance with one aspect of the present disclosure. The cosmetics brush holder 100 can be formed as a cup 105 in example aspects, and can comprise a holder body 110 and one or more brush retainers 150 coupled to the holder body 110. In the present aspect, each of the brush retainers 150 can be monolithically formed (i.e., formed a singular component that constitutes a single material without joints or seams) with the holder body 110. However, in other aspects, such as the aspect shown in FIG. 8, some or all of the brush retainers 150 can be formed separately from the holder body 110 and attached thereto. Other aspects of the cosmetics brush holder 100 can comprise more or fewer brush retainers 150, or may not comprise any of the brush retainers 150.

In the present aspect, the cosmetics brush holder 100, including the monolithic brush retainers 150, can be formed from a flexible, resilient material, such as silicone, for example and without limitation. In other aspects, the cosmetics brush holder 100 and/or the brush retainers 150 can be more less flexible and/or resilient, and in some aspects, the cosmetics brush holder 100 and/or the brush retainers 150 can be substantially rigid. In other aspects, the cosmetics brush holder 100 and/or the brush retainers 150 can comprise any other suitable material or combination of materials, including rubbers, plastics, composites, metals, and the like. For example, the holder body 110 of FIGS. 5-8 can comprise a more rigid plastic material. The brush retainer 150 of FIGS. 7-10 can also comprise a semi-rigid plastic material that can still allow for some flexibility, as described in further detail below.

The holder body 110 of the cosmetics brush holder 100 can define an upper end 112 and a lower end 114 opposite the upper end 112. Example aspects of the holder body 110 can comprise a holder base 220 (shown in FIG. 2) and a holder sidewall 130 extending substantially upward from a peripheral edge 125 of the holder base 220, relative to the orientation shown. The holder base 220 can be formed at the lower end 114 of the cosmetics brush holder 100, and the holder sidewall 130 can extend substantially from the lower end 114 to the upper end 112. The holder sidewall 130 can define an inner sidewall surface 132 and an outer sidewall surface 134. Each of the brush retainers 150 can extend outward from the outer sidewall surface 134, as described in further detail below.

Furthermore, the holder base 220 can define an inner base surface 322 (shown in FIG. 3) and an outer base surface 224 (shown in FIG. 2). The outer base surface 224 can be substantially planar or at least partially planar and can be configured to rest on a support surface, such as a countertop, table top, or the like. The inner base surface 322 of the holder base 220 and the inner sidewall surface 132 of the holder sidewall 130 can define an interior cavity 170 of the cosmetics brush holder 100. A cavity axis 171 can extend centrally through the interior cavity 170, as shown. As shown, an upper sidewall edge 136 of the holder sidewall 130 can define a cavity opening 172 at the upper end 112 of the cosmetics brush holder 100, which can allow access to the interior cavity 170.

In example aspects, the holder base 220 can define a wavy or undulating pattern at the peripheral edge 125 thereof, such that the peripheral edge 125 can define a plurality of alternating lower peaks 126 and lower valleys 128. For example and without limitation, the wavy/undulating pattern can be substantially sinusoidal in some aspects. The holder sidewall 130 extending upward from the peripheral edge 125 of the holder base 220 can also define a wavy or undulating pattern (e.g., sinusoidal) about its circumference. The outer sidewall surface 134 of the holder sidewall 130 can define the undulating pattern, such that the outer sidewall surface 134 can define a plurality of alternating elongate outer sidewall grooves 138 and elongate outer sidewall ridges 140. In example aspects, the outer sidewall surface 134 can be substantially flush with the peripheral edge 125 of the holder base 220.

The inner sidewall surface 132 can also define the undulating pattern. As such, for every outer sidewall groove 138 defined by the outer sidewall surface 134, the inner sidewall surface 132 can define a corresponding elongate inner sidewall ridge 144, and for every outer sidewall ridge 140, the inner sidewall surface 132 can define a corresponding elongate inner sidewall groove 142. That is, each of the outer sidewall ridges 140 can substantially conform to and accommodate a corresponding one inner sidewall grooves 142, and each of the inner sidewall ridges 144 can substantially conform to and accommodate a corresponding one of the outer sidewall grooves 138. For example, as shown, outer sidewall ridge 140*a* defined by the outer sidewall surface 134 can correspond to inner sidewall groove 142*a* defined by the inner sidewall surface 132. Each of the outer sidewall grooves 138, the outer sidewall ridges 140, the inner sidewall grooves 142, and the inner sidewall ridges 144 can extend substantially along a height of the holder sidewall 130, from the holder base 220 at the lower end 114 of the cosmetics brush holder 100 to the upper end 112. The cavity opening 172 can define the wavy or undulating (e.g., sinusoidal) pattern at the upper end 112, such that the upper end 112 of the cosmetics brush holder 100 can define a plurality of alternating upper peaks 127 and upper valleys 129.

According to example aspects, cosmetics brushes 810 (shown in FIG. 8) and/or other cosmetics and cosmetics tools can be supported within the interior cavity 170 of the cosmetics brush holder 100. In example aspects, each cosmetics brush 810 can comprise a handle 812 (shown in FIG. 8) and a brush head 816 (shown in FIG. 8). Some aspects of the handle 812 can comprise a ferrule 818 (shown in FIG. 8), and the brush head 816 can be coupled to the ferrule 818. The handle 812 of each of the cosmetics brushes 810 can be configured to rest within a corresponding one of the inner sidewall grooves 142 when disposed within the interior cavity 170. In example aspects, some or all of the cosmetics brushes 810 can be oriented in a brush-head up orientation within the interior cavity 170. In the brush-head up orientation, a distal handle end 814 (shown in FIG. 8) of the handle 812 can rest against the holder base 220 and the handle 812 can extend substantially upward within the cosmetics brush holder 100 from the distal handle end 814 to the brush head 816. In some aspects, the brush head 816 of some or all of the cosmetics brushes 810 can extend beyond the cavity opening 172 to be disposed outside of the interior cavity 170 in the brush-head up orientation. Furthermore, in some aspects, some or all of the cosmetics brushes 810 within the interior cavity 170 can be oriented in a brush-head down orientation, wherein the brush head 816 of the cosmetics brush 810 can rest against the holder base 220 and the handle 812 can extend substantially upward from the brush head 816 to the distal handle end 814. In some aspects, the distal handle end 814 can extend beyond the cavity opening 172 to be disposed outside of the interior cavity 170 in the brush-head down orientation. The holder base 220 and the engagement of the cosmetics brushes 810 therewith are described in further detail with respect to FIGS. 3 and 4.

Some or all of the cosmetics brushes 810 can also or alternatively be retained against the outer sidewall surface 134 within the outer sidewall grooves 138 by the brush retainers 150. In the present aspect, each of the brush retainers 150 can comprise a curved or arcuate retaining segment 155 extending from the outer sidewall surface 134. Other aspects of the retaining segments 155 may be substantially angular. Each of the arcuate retaining segments 155 can extend laterally across a corresponding one of the outer sidewall grooves 138 and can arc outwardly from the outer sidewall surface 134. A first segment end 156 can be connected to the outer sidewall groove 138 at a first groove side 160 thereof, and a second segment end 158 can be connected to the outer sidewall groove 138 at a second groove side 162 thereof. In other aspects, the first segment end 156 and the second segment end 158 can be connected to adjacent outer sidewall ridges 140.

As shown, the arcuate retaining segments 155 can be arranged proximate to the upper end 112 of the cosmetics brush holder 100. However, in other aspects, some or all of the arcuate retaining segments 155 can be arranged nearer to or further from the upper end 112 of the cosmetics brush holder 100. For example, in other aspects, some or all of the arcuate retaining segments 155 can be positioned about midway between the upper end 112 and the lower end 114 of the cosmetics brush holder 100. The arcuate retaining segments 155 of the present aspect can be formed monolithically with the holder body 110, and thus can comprise the same flexible and resilient silicone material as the holder body 110. As previously mentioned, in other aspects, the holder body 110 and the monolithic arcuate retaining segments 155 can comprise any other suitable material, including resilient, semi-rigid, and rigid materials. In other aspects, the arcuate retaining segments 155 can be formed separately from the holder body 110 and attached thereto, and/or the arcuate retaining segments 155 can comprise a material(s) different from the material(s) of the holder body 110.

Each of the arcuate retaining segments 155 and the corresponding outer sidewall groove 138 can cooperate to define a continuous retaining loop 165 (indicated by a dashed line). Each of the retaining loops 165 can be substantially oval-shaped or circular in the present aspect. A cosmetics brush 810 can be retained within the corresponding outer sidewall groove 138 by receiving a portion of the handle 812 through a corresponding one of the retaining loops 165. The cosmetics brushes 810 can be oriented in the brush-head up orientation or the brush-head down orientation when received through the retaining loops 165. In some aspects, in the brush-head up orientation, the distal handle end 814 of the corresponding cosmetics brush 810 can rest on the support surface (e.g., the counter top). In other aspects, the distal handle end 814 can be suspended above the support surface. Moreover, in the brush-head down orientation, the brush head 816 of the corresponding cosmetics brush 810 can be suspended above the support surface in some aspects, and may contact or rest on the support surface in other aspects. As described above, in some aspects, the holder body 110 and/or the arcuate retaining segments 155 can comprise a flexible, resilient material that can flex to accommodate handles 812 of varying shapes and sizes.

Furthermore, in some aspects, the arcuate retaining segments 155 themselves can define varying sizes and/or shapes to form retaining loops 165 of varying sizes and/or shapes. For example, referring to FIG. 2, the one or more arcuate retaining segments 155 can comprise six arcuate retaining segments 155*a,b,c,d,e,f*, and the length of the six arcuate retaining segments 155*a,b,c,d,e,f* can vary. In other aspects, the cosmetics brush holder 100 can comprise more or fewer arcuate retaining segments 155. As shown, the arcuate retaining segments 155*a,b,c* can be sized smaller (i.e., can have a shorter length) than the other arcuate retaining segments 155*d,e,f*. Thus, various dimensions (e.g., length, depth, and/or area) of the retaining loops 165 corresponding to the smaller retaining segments 155*a,b,c* can be less than the dimensions of the retaining loops 165 corresponding to the larger retaining segments 155*d,e,f*. The smaller arcuate retaining segments 155*a,b,c* can be configured to accommodate cosmetics brushes 810 (shown in FIG. 8) having thinner handles 812 (shown in FIG. 8). The arcuate retaining segment 155*f* can be sized larger (i.e., can have a longer length) than the other arcuate retaining segments 155*a,b,c, d,e* to accommodate cosmetics brushes 810 having thicker handles 812. The arcuate retaining segments 155*d,e* can be sized larger than the arcuate retaining segments 155*a,b,c* and sized smaller than the arcuate retaining segment 155*f* to accommodate cosmetics brushes 810 having handles 812 of an intermediate thickness.

In some aspects, various dimensions of the arcuate retaining segments 155 other than or in addition to length, such as thickness for example, can vary. In some aspects, a depth of the outer sidewall grooves 138 (extending radially inward relative to the cavity axis 171) can vary to define retaining loops 165 of varying depths. The cavity axis 171 is shown extending into the page in the present view. Furthermore, in some aspects, the shape of the outer sidewall grooves 138 and/or the shape of the retaining segments 155 can vary to modify the shape of the corresponding retaining loops 165. For example and without limitation, some or all of retaining loops 165 can be substantially square-shaped in some aspects.

Additionally, the retaining loop 165*c* defined by arcuate retaining segment 155*c* and the corresponding outer sidewall groove 138 can be divided into two even smaller sub-loops 245 to accommodate cosmetics brushes 810 having very thin handles 812. As shown, a divider segment 240 can extend from a center 211 of the corresponding outer sidewall groove 138 to a center 213 of the arcuate retaining segment 155*c*, thereby separating the corresponding retaining loop 165*c* into a first sub-loop 245*a* adjacent to the first groove side 160 and a second sub-loop 245*b* adjacent to the second groove side 162. In the present aspect, the first and second sub-loops 245*a,b* can be substantially the same in size and shape. However, in other aspects, the divider segment 240 can be off-center to form first and second sub-loops 245*a,b* of differing shapes and sizes. In other aspects, the retaining loop 165*c* can be segmented into additional sub-loops 245 by additional divider segments 240. Furthermore, in other aspects, additional retaining loops 165 of the cosmetics brush holder 100 can be segmented into two or more of the sub-loops 245. In other aspects, none of the retaining loops 165 may be segmented into sub-loops 245.

In some aspects, cosmetics brushes 810 engaged with the retaining loops 165 can be supported above the support surface (e.g., counter top, etc.). In other aspects, some or all of the cosmetics brushes 810 engaged with the retaining loops 165 can engage the support surface. According to example aspects, each of the cosmetics brushes 810 engaged with the retaining loops 165 can be spaced apart from adjacent cosmetics brushes 810, improving air flow between the cosmetics brushes 810 and facilitating drying of the cosmetics brushes 810 (for example, after cleaning the cosmetics brushes 810). Additionally, in some aspects, the cosmetics brushes 810 can be supported in the brush-head down orientation within the retaining loops 165, which can facilitate drying by allowing water (or other moisture, such as a cleaning solution) in the brush head 816 to flow downward and away from the handle 812 (which can include a ferrule 818, show in FIG. 8, in some aspects). Additionally, spacing the cosmetics brushes 810 apart from adjacent cosmetics brushes 810 allows for better visibility of each of the cosmetics brushes 810, thereby allowing for quicker selection of a desired cosmetics brush 810. Similarly, cosmetics brushes 810 received in the interior cavity 170 (shown in FIG. 1) can be spaced apart from adjacent cosmetics brushes 810 by receiving each of the cosmetics brushes 810 within a separate, corresponding one of the inner sidewall grooves 142 (shown in FIG. 1), thereby facilitating the drying and visibility of the cosmetics brushes 810 within the interior cavity 170.

In some aspects, a width of the holder sidewall 130 can taper generally from the upper end 112 of the holder body 110 to the holder base 220 at the lower end 114 of the holder body 110. For example, as shown, an upper width W1 of the holder sidewall 130 at the upper end 112 can be greater than a lower width W2 of the holder sidewall 130 at the holder base 220. The taper of holder sidewall 130 can facilitate retaining the cosmetics brushes 810 in the corresponding inner sidewall grooves 142.

Figure 3:
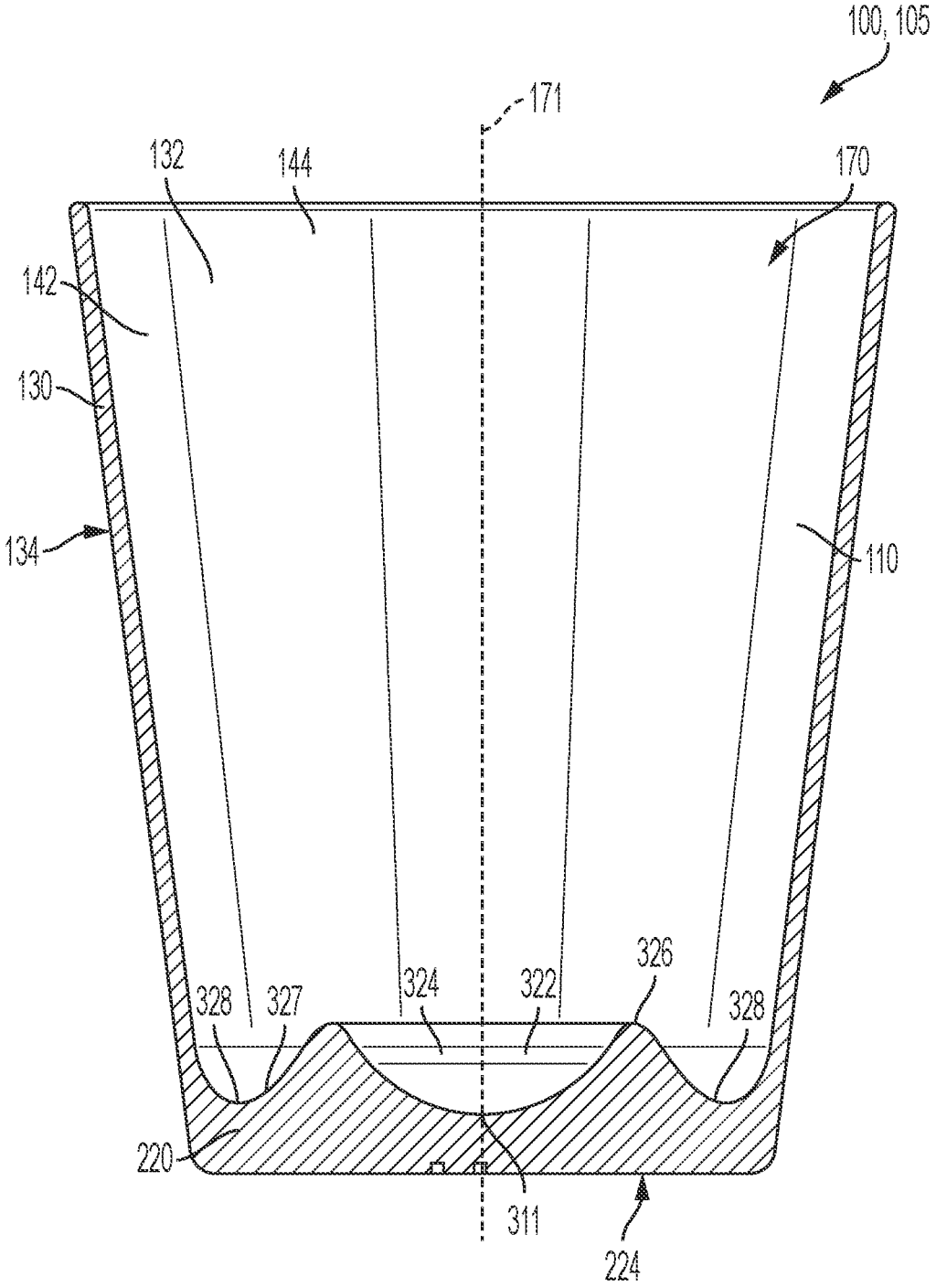
FIG. 3 is a cross-sectional view of the cosmetics brush holder of FIG. 1 taken along line 3-3 in FIG. 1.
Figure 4:
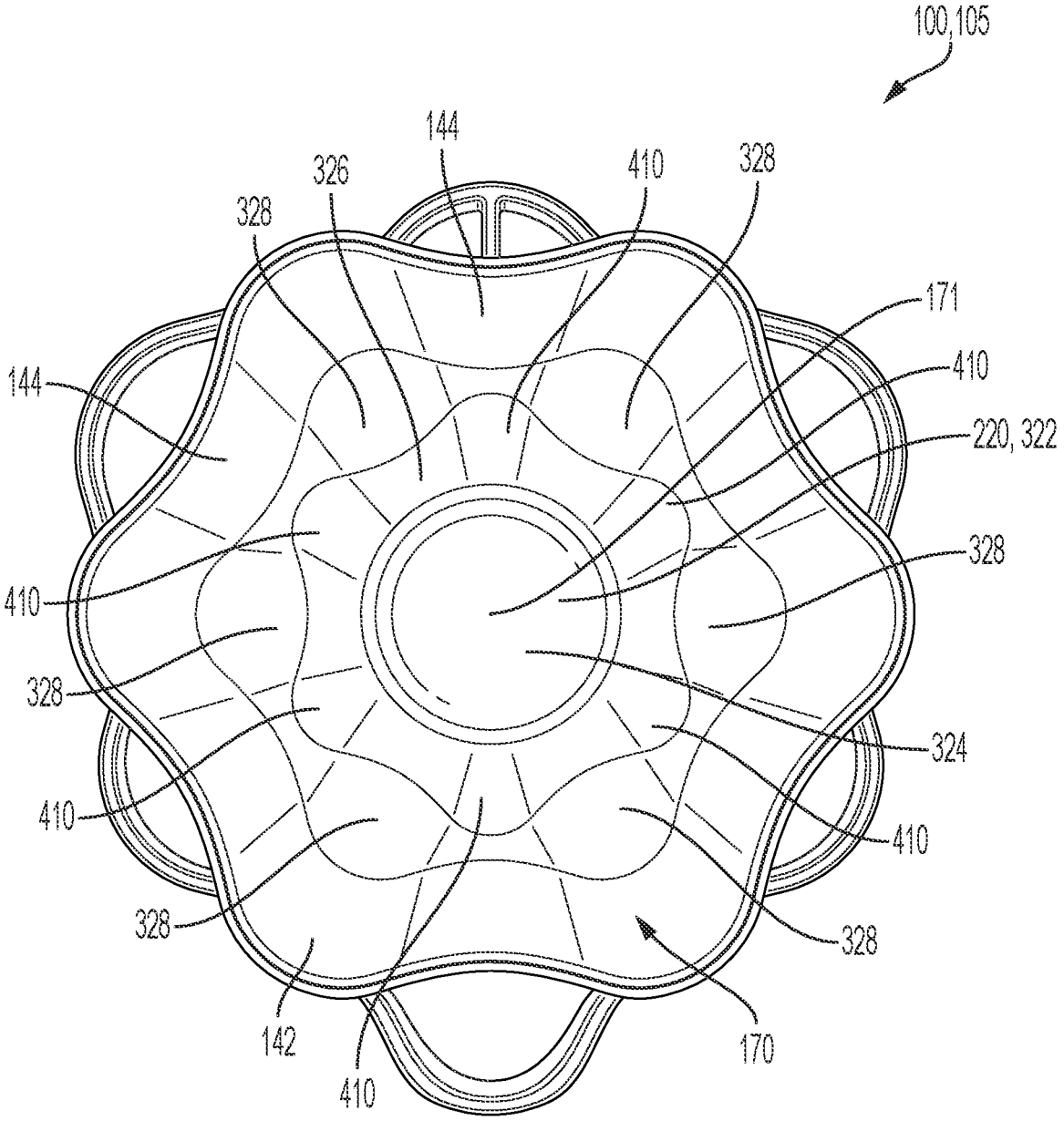
FIG. 4 is a top view of the cosmetics brush holder of FIG. 1.

FIG. 3 illustrates a cross-sectional view of the cosmetics brush holder 100 taken along line 3-3 in FIG. 1, such that the inner base surface 322 of the holder base 220 is visible. FIG. 4 illustrates a top view of the cosmetics brush holder 100, wherein the inner base surface 322 of the holder base 220 is visible. Referring to FIG. 3, examples aspects of the inner base surface 322 can define a recessed center pocket 324 at a center 311 of the holder base 220. The recessed center pocket 324 can be substantially concave and can define an arcuate cross-sectional shape, as shown in the present view. The recessed center pocket 324 can be encircled by a substantially circular rim 326 of the inner base surface 322. In example aspects, the inner base surface 322 can further define a substantially base groove 327 disposed between the substantially circular rim 326 and the inner sidewall surface 132 of the holder sidewall 130. The base groove 327 can be substantially annular and can be segmented into a plurality of outer groove pockets 328 in some aspects. Each of the outer groove pockets 328 can be formed adjacent to a corresponding one of the inner sidewall grooves 142, as best seen in the top view of FIG. 4. In other aspects, the base groove 327 may not be segmented into the plurality of outer groove pockets 328.

Referring to FIG. 4, in the present aspect, the inner base surface 322 of the holder base 220 can define a plurality of rim spokes 410, and each rim spoke 410 can extend radially outward relative to the cavity axis 171 (shown extending into the page) from the substantially circular rim 326 towards a corresponding one of the inner sidewall ridges 144. In the present aspect, the rim spokes 410 do not extend all the way to the inner sidewall ridges 144; however, in other aspects, each of the rim spokes 410 may extend fully between the substantially circular rim 326 and the inner sidewall surface 132. In other aspects, each of the rim spokes 410 can extend radially inward relative to the cavity axis 171 from a corresponding one of the inner sidewall ridges 144 towards the circular rim 326. As shown, each of the outer groove pockets 328 can generally be defined between an adjacent pair of the rim spokes 410. According to example aspects, the distal handle end 814 (shown in FIG. 8) of each cosmetics brush 810 (shown in FIG. 8) received in the interior cavity 170 can rest within the recessed center pocket 324 of the inner base surface 322, and the cosmetics brush 810 can lean radially outward towards the inner sidewall surface 132, relative to the cavity axis 171, and can be supported substantially upright within a corresponding one of the inner sidewall grooves 142. In other aspects, the distal handle end 814 can rest within the outer groove pocket 328 adjacent to the corresponding inner sidewall groove 142. In other aspects, the brush head 816 (shown in FIG. 8) of the cosmetics brush 810 can rest within the recessed center pocket 324 or the corresponding outer groove pocket 328. Furthermore, in other aspects, the inner base surface 322 can define any other suitable contour or may be substantially flat.

Figure 5:
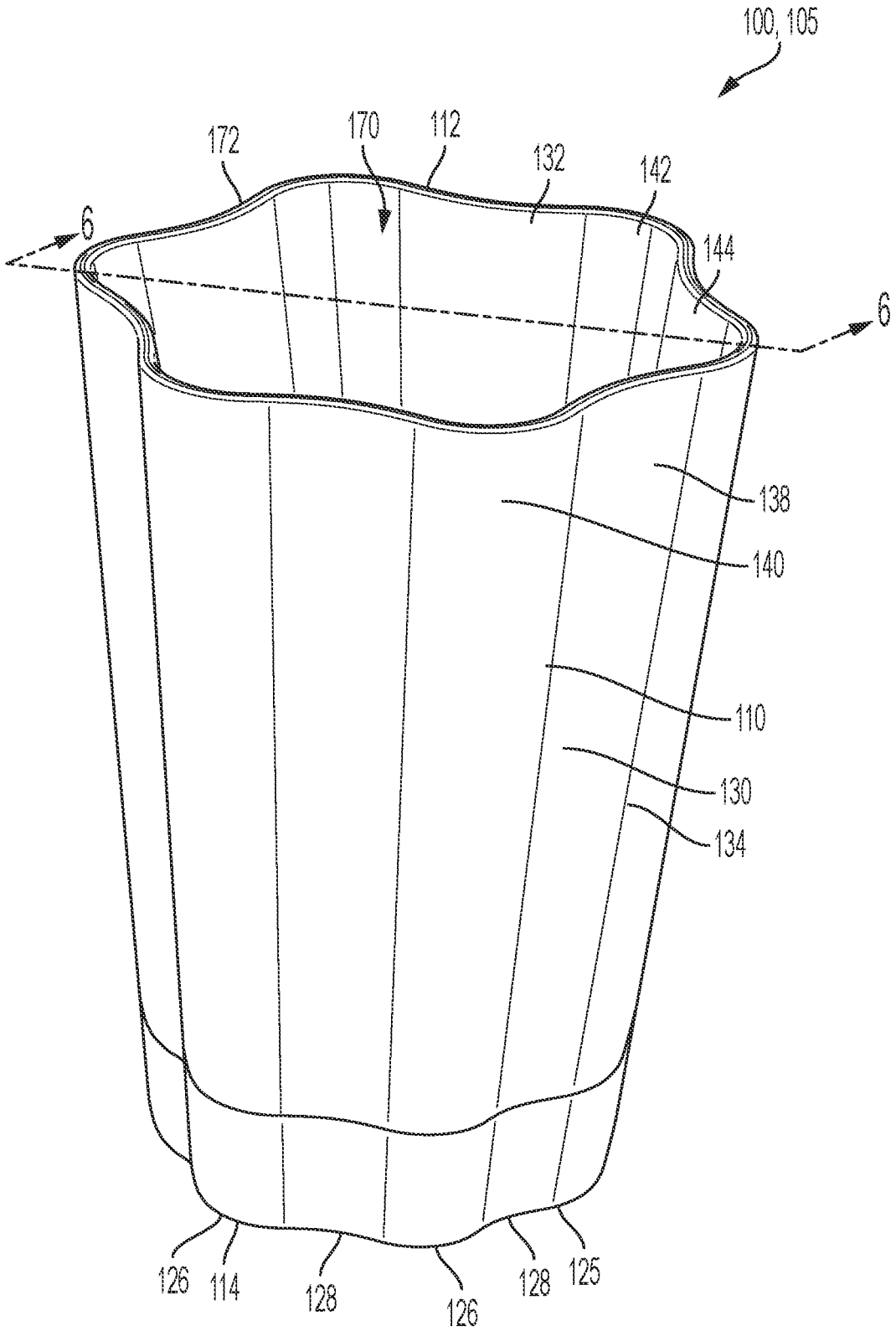
FIG. 5 is a perspective view of the cosmetics brush holder, in accordance with another aspect of the present disclosure.
Figure 6:
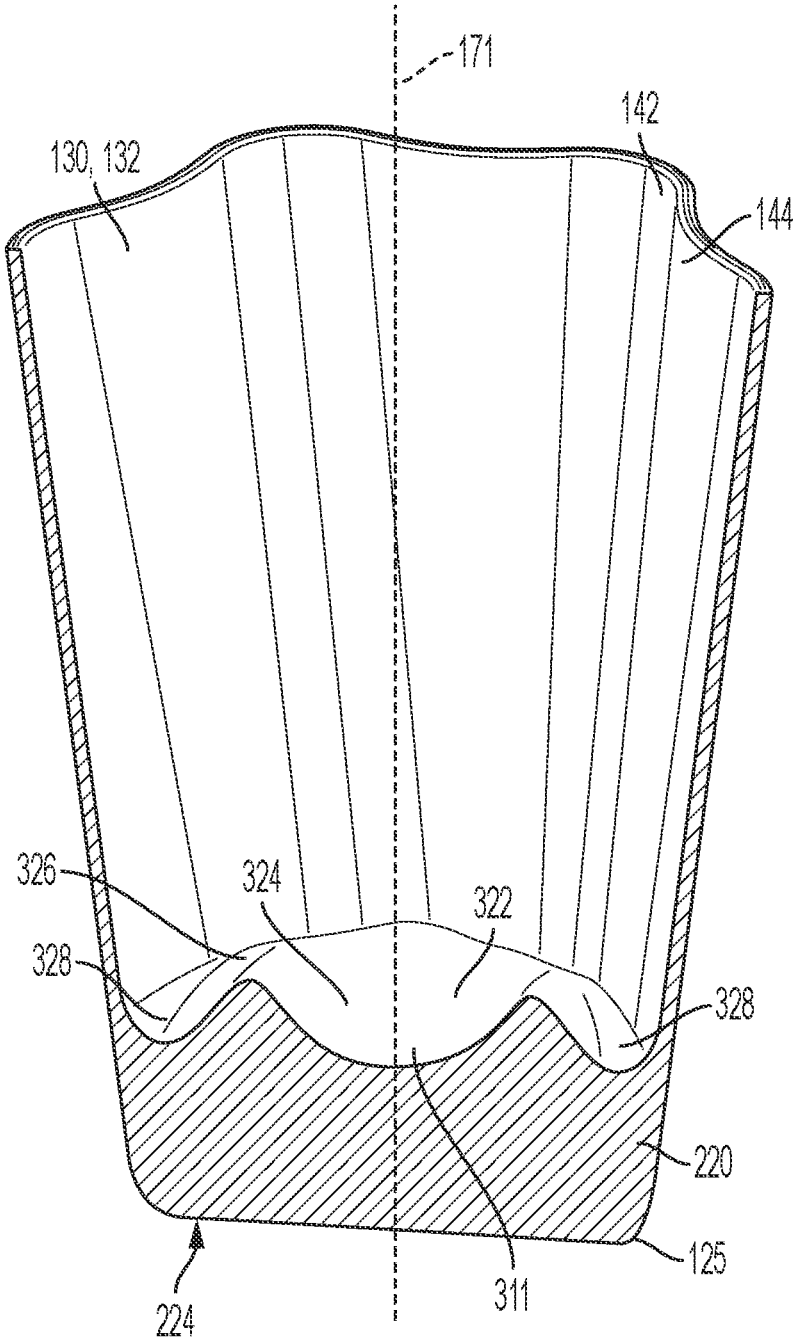
FIG. 6 is a cross-sectional view of the cosmetics brush holder of FIG. 5 taken along line 6-6 in FIG. 5.

FIGS. 5 and 6 illustrate the cosmetics brush holder 100 according to another example aspect of the invention. The cosmetics brush holder 100 again can be formed as the cup 105. In the present aspects, the cosmetics brush holder 100 comprises the holder body 110 only, and does not comprise the one or more brush retainers 150 formed monolithically therewith. As shown, the holder body 110 of the present aspect can be substantially similar to or the same as the holder body 110 of the previous aspect. For example, referring to FIG. 5, the holder body 110 can define the upper end 112 and a lower end 114. The holder body 110 can comprise the holder base 220 (shown in FIG. 6) formed at the lower end 114 and the holder sidewall 130 extending substantially upward from the peripheral edge 125 of the holder base 220 between the upper and lower ends 112,114. The holder sidewall 130 can define the inner sidewall surface 132 and the outer sidewall surface 134. The inner base surface 322 (shown in FIG. 6) and the inner sidewall surface 132 can together define the interior cavity 170 of the cosmetics brush holder 100. The cavity opening 172 can be defined by the holder sidewall 130 at the upper end 112 of the cosmetics brush holder 100. Additionally, the holder base 220 can define the wavy or undulating pattern at the peripheral edge 125 thereof to define the alternating lower peaks 126 and lower valleys 128. The holder sidewall 130 can also define the wavy or undulating pattern, such that the outer sidewall surface 134 can define the alternating elongate outer sidewall grooves 138 and elongate outer sidewall ridges 140, and such that the inner sidewall surface 132 can define the elongate inner sidewall grooves 142 and inner sidewall ridges 144. For example and without limitation, the wavy/undulating pattern of the holder base 220 and the holder sidewall 130 can be substantially sinusoidal in some aspects.

Referring to FIG. 6, the inner base surface 322 can define the recessed center pocket 324 at the center 311 of the holder base 220 and can further define a plurality of the outer groove pockets 328 disposed between the substantially circular rim 326 and the inner sidewall surface 132 of the holder sidewall 130. Each of the outer groove pockets 328 can be formed adjacent to a corresponding one of the inner sidewall grooves 142. Each of the outer groove pockets 328 can be formed between an adjacent pair of the rim spokes 410 (shown in FIG. 4). As described above, in example aspects, the distal handle end 814 (shown in FIG. 8) of each cosmetics brush 810 (shown in FIG. 8) can be configured to rest within the recessed center pocket 324 of the inner base surface 322, and the cosmetics brush 810 can lean radially outward towards the inner sidewall surface 132, relative to the cavity axis 171, and can be supported substantially upright within a corresponding one of the inner sidewall grooves 142. In other aspects, the distal handle end 814 can rest within the outer groove pocket 328 adjacent to the corresponding inner sidewall groove 142. The cosmetics brush holder 100 of the present aspect can comprise a more rigid material, such as, for example and without limitation, a hard plastic. In other aspects, however, the cosmetics brush holder 100 can be formed from any other suitable material known in the art, including flexible and resilient materials, such as silicone or rubber.

Figure 7:
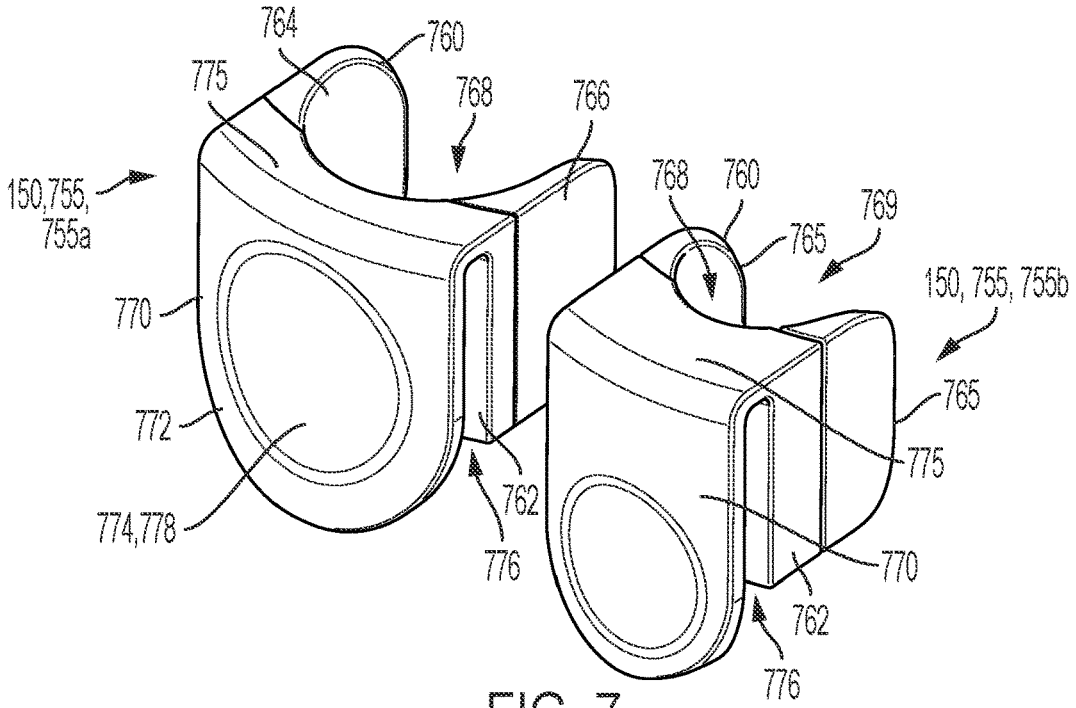
FIG. 7 is a perspective view of a pair of brush retaining clips according to an example aspect of the present disclosure.

FIG. 7 illustrates another example aspects of the brush retainers 150, wherein the brush retainers 150 can be formed separately from the cosmetics brush holder 100 (shown in FIG. 8) and attached thereto. In the present aspect, the brush retainers 150 can be formed as brush retaining clips 755. For example, a larger brush retaining clip 755*a* and a smaller brush retaining clip 755*b* are shown. Each of the brush retaining clips 755 can define a substantially C-shaped clip portion 760 configured to clip partially around the handle 812 (shown in FIG. 8) of a corresponding cosmetics brush 810 (shown in FIG. 8) therethrough. In other aspects, the clip portion 760 can be substantially annular and can be configured to fully encircle the handle 812. Each clip portion 760 can define a body portion 762, an arcuate first leg 764 extending from the body portion 762, and an arcuate second leg 766 extending from the body portion 762 opposite the first leg 764. A handle channel 768 can be defined between the first and second legs 764,766 and can extend in a substantially longitudinal direction, relative to the orientation shown. A channel gap 769 can be defined between distal leg ends 765 of the first and second legs 764,766 and can allow lateral access to the handle channel 768, relative to the orientation shown. In some aspects, the brush retaining clips 755 can be formed from a semi-rigid material having enough flexibility to allow the first and second legs 764,766 to be biased apart as the handle 812 of a cosmetics brush 810 is pushed laterally into the handle channel 768 through the channel gap 769, relative to the orientation shown. For example, the brush retaining clips 755 can be formed a semi-rigid plastic material. In other aspects, however, the brush retaining clips 755 can comprise any suitable material, including rigid, semi-rigid, and flexible materials. According to example aspects, the handle 812 of the cosmetics brush 810 can also be inserted longitudinally through the handle channel 768 in a substantially upward or downward direction, relative to the orientation shown.

Figure 9:
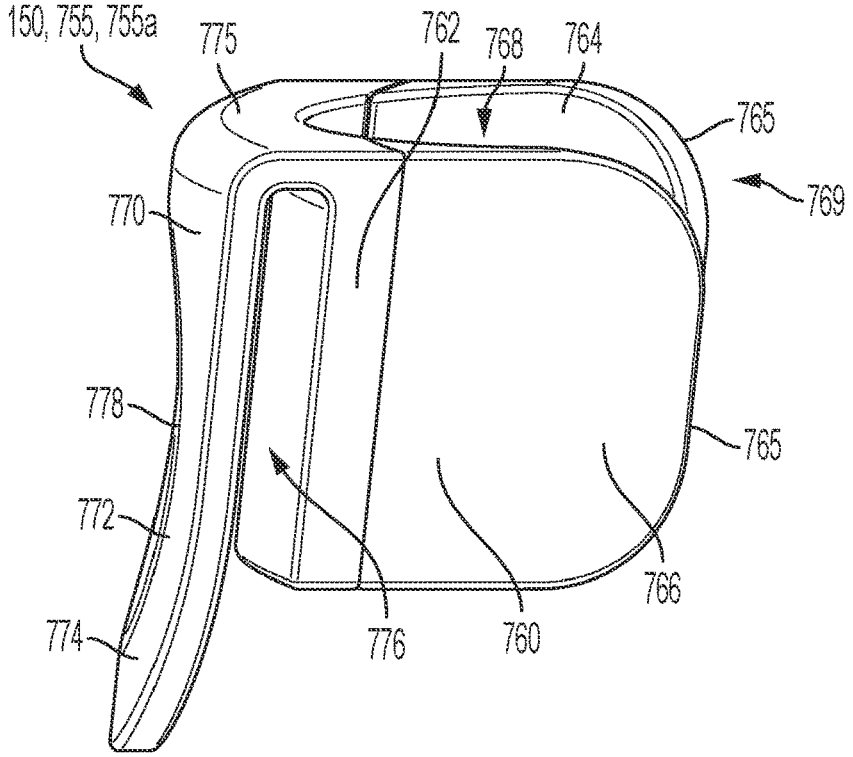
FIG. 9 is a side view of one of the brush retaining clips of FIG. 7.
Figure 10:
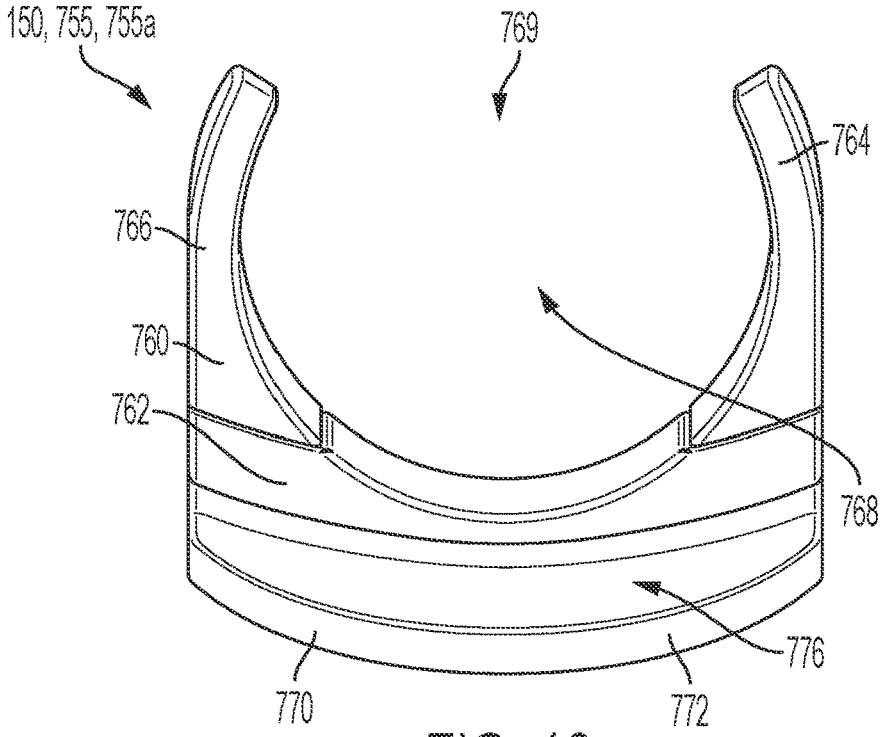
FIG. 10 is a bottom view of the brush retaining clip of FIG. 9.

Each of the brush retaining clips 755 can further define a substantially U-shaped mounting portion 770. The mounting portion 770 can be partially defined by the body portion 762 and further defined by a mounting tab 772 and a mounting shoulder 775 extending between the body portion 762 and the mounting tab 772. The mounting portion 770 can define a downward facing mounting slot 776 formed between the body portion 762 and the mounting tab 772, as shown. The upper sidewall edge 136 (shown in FIG. 8) of the holder sidewall 130 (shown in FIG. 8) can be configured to engage the mounting slot 776, and the mounting shoulder 775 can rest on the upper sidewall edge 136 to mount the brush retaining clip 755 on the cosmetics brush holder 100. Specifically, in some aspects, each of the brush retaining clips 755 can be mounted to the holder sidewall 130 at a corresponding one of the outer sidewall grooves 138 (shown in FIG. 1). Moreover, in some aspects, the mounting slot 776 can be curved (as best seen in FIG. 10) to conform to the outer sidewall groove 138 and the corresponding inner sidewall ridge 114. In some aspects, the mounting tab 772 of the mounting portion 770 can define a grip indentation 778 formed in an outer tab surface 774 thereof. The grip indentation 778 can be engaged by a user's finger, such as a thumb, to facilitate gripping the brush retaining clip 755 when attaching the brush retaining clip 755 to the cosmetics brush holder 100 or removing the brush retaining clip 755 from the cosmetics brush holder 100. FIGS. 9 and 10 illustrate side and bottom views of the larger brush retaining clip 755*a*.

Figure 8:
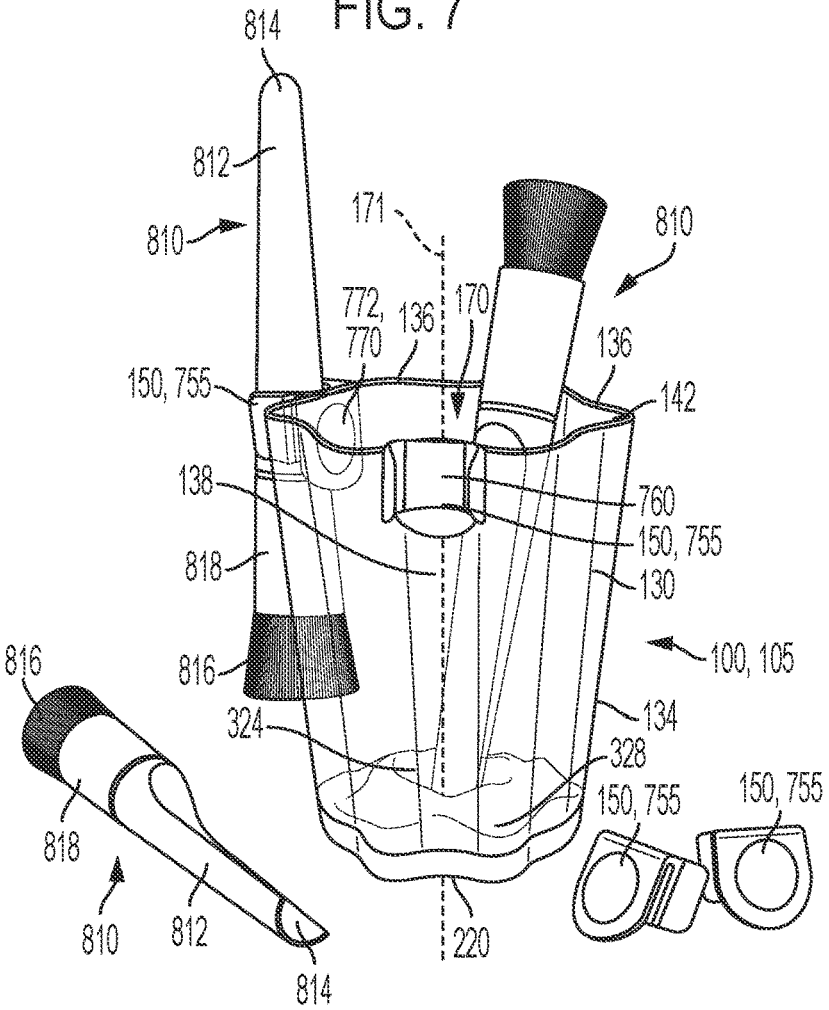
FIG. 8 is a perspective view of cosmetics brush holder, in accordance with another aspect of the present disclosure, wherein the cosmetics brush holder comprises the brush retaining clips of FIG. 7.

FIG. 8 illustrates a pair of the brush retaining clips 755 coupled to holder body 110 of the cosmetics brush holder 100 of FIGS. 5-6. The outer base surface 224 (shown in FIG. 6) of the holder base 220 can rest on a support surface (e.g., a counter top). As shown, the upper sidewall edge 136 of the holder sidewall 130 can engage the mounting slot 776 (shown in FIG. 7) of each U-shaped mounting portion 770 to mount the corresponding brush retaining clip 755 on the cosmetics brush holder 100. When mounted to the cosmetics brush holder 100, the mounting tab 772 of the mounting portion 770 can be disposed substantially within the interior cavity 170 and the C-shaped clip portion 760 can extend radially outward, relative to the cavity axis 171, from the outer sidewall surface 134 of the holder sidewall 130. Cosmetics brushes 810 can be disposed within the interior cavity 170 of the cosmetics brush holder 100, as shown and as described in detail above.

Furthermore, each of the brush retaining clips 755 can be configured to support a corresponding cosmetics brush 810 outside of the interior cavity 170. In example aspects, each of the brush retaining clips 755 can be mounted to the holder sidewall 130 at a corresponding one of the outer sidewall grooves 138 to retain the cosmetics brush 810 at least partially within the outer sidewall groove 138. As shown, in example aspects, the cosmetics brushes 810 supported by the brush retaining clips 755 can be supported above the support surface. Furthermore, as shown, the cosmetics brushes 810 supported by the brush retaining clips 755 can be supported in the brush-head down orientation, which can facilitate the drying of the cosmetics brush 810 by allowing water in the brush head 816 to flow away from the ferrule 818 and handle 812. The cosmetics brushes 810 can also be supported in the brush-head up orientation by the brush retaining clips 755 if desired and/or may engage the support surface. In example aspects, the brush retaining clips 755 can be selectively removable from the holder body 110, such that the brush retaining clips 755 can be removed from and attached thereto as desired. Furthermore, each of the cosmetics brushes 810 received within the interior cavity 170 of the cosmetics brush holder 100 can engage a corresponding one of the inner sidewall grooves 142, as described in detail above. Moreover, the distal handle end 814 of each cosmetics brush 810 received in the interior cavity 170 can rest within the recessed center pocket 324 or a corresponding one of the outer groove pockets 328.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment. It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A cosmetics brush holder comprising:

a holder base defined at a lower end of the cosmetics brush holder, the holder base defining an inner base surface and an outer base surface opposite the inner base surface, the inner base surface defining an annular base groove;

a holder sidewall defining an undulating pattern about a circumference of the holder sidewall, the holder sidewall defining an inner sidewall surface and an outer sidewall surface opposite the inner sidewall surface, the inner sidewall surface defining a plurality of alternating inner sidewall grooves and inner sidewall ridges; and an interior cavity defined by the inner base surface and the inner sidewall surface and configured to receive cosmetics brushes;

wherein the annular base groove is segmented into a plurality of outer groove pockets by a plurality of rim spokes defined by the inner base surface, each rim spoke extending radially outward from a longitudinal center axis of the interior cavity toward the inner sidewall surface of the holder sidewall.

2. The cosmetics brush holder of claim 1, wherein the holder sidewall extends substantially from the holder base to an upper end of the cosmetics brush holder opposite the lower end, and wherein the holder sidewall defines a cavity opening at the upper end, the cavity opening allowing access to the interior cavity.

3. The cosmetics brush holder of claim 2, wherein:

a width of the holder sidewall is tapered substantially from the upper end of the cosmetics brush holder to the holder base; and an upper width of the holder sidewall at the upper end is greater than a lower width of the holder sidewall at the holder base.

4. The cosmetics brush holder of claim 1, wherein:

the outer sidewall surface defines a plurality of alternating outer sidewall grooves and outer sidewall ridges;

each of the outer sidewall ridges accommodates one of the inner sidewall grooves; and each of the inner sidewall ridges accommodates one of the outer sidewall grooves.

5. The cosmetics brush holder of claim 4, wherein:

the holder base defines a peripheral edge;

the peripheral edge of the holder base defines an undulating pattern; and the outer sidewall surface is substantially flush with the peripheral edge of the holder base.

6. The cosmetics brush holder of claim 1, wherein the inner base surface of the holder base defines a recessed center pocket at a center of the holder base.

7. The cosmetics brush holder of claim 6, wherein the recessed center pocket is substantially concave, and wherein the inner base surface further defines a substantially circular rim encircling the recessed center pocket.

8. The cosmetics brush holder of claim 7, wherein the annular base groove is disposed between the substantially circular rim and the inner sidewall surface of the holder sidewall.

9. The cosmetics brush holder of claim 8, wherein each of the plurality of outer groove pockets is formed adjacent to one of the inner sidewall grooves.

10. The cosmetics brush holder of claim 1, wherein the cosmetics brush holder comprises a silicone material.

11. The cosmetics brush holder of claim 1, wherein the cosmetics brush holder comprises plastic material.

12. A cosmetics brush holder comprising:

a holder body, the holder body defining a holder base and a holder sidewall, the holder sidewall extending from the holder base and defining an inner sidewall surface and an outer sidewall surface opposite the inner sidewall surface, the holder base defining an inner base surface and an outer base surface opposite the inner base surface, the inner base surface defining an annular base groove;

an interior cavity defined by the inner base surface and the inner sidewall surface and configured to receive a first cosmetics brush; and a brush retainer extending outward from the outer sidewall surface of the holder sidewall, the brush retainer configured to secure a second cosmetics brush to the holder body external to the interior cavity;

wherein the annular base groove is segmented into a plurality of outer groove pockets by a plurality of rim spokes defined by the inner base surface, each rim spoke extending radially outward from a longitudinal center axis of the interior cavity toward the inner sidewall surface of the holder sidewall.

13. The cosmetics brush holder of claim 12, wherein the brush retainer cooperates with the outer sidewall surface of the holder sidewall to define a continuous retaining loop through which a handle of the second cosmetics brush is received.

14. The cosmetics brush holder of claim 13, wherein:

the brush retainer comprises a curved retaining segment;

the curved retaining segment defines a first segment end connected to the outer sidewall surface and a second segment end connected to the outer sidewall surface opposite the first segment end; and the curved retaining segment extends laterally across a portion of the outer sidewall surface and arcing outward and away from the outer sidewall surface.

15. The cosmetics brush holder of claim 14, wherein the brush retainer is formed monolithically with the holder body.

16. The cosmetics brush holder of claim 15, wherein the cosmetics brush holder comprises a silicone material.

17. The cosmetics brush holder of claim 14, wherein:

a cavity axis is defined through a center of the interior cavity;

the holder sidewall defines an undulating pattern about a circumference of the holder sidewall;

the outer sidewall surface defines a plurality of alternating outer sidewall grooves extending radially inward relative to the interior cavity and outer sidewall ridges extending radially outward relative to the interior cavity; and the curved retaining segment cooperates with one of the outer sidewall grooves to define the continuous retaining loop.

18. The cosmetics brush holder of claim 13, further comprising a divider segment extending across the continuous retaining loop between the outer sidewall surface and the brush retainer, the divider segment dividing the continuous retainer loop into a first sub-loop and a second sub-loop.

19. The cosmetics brush holder of claim 13, wherein:

the brush retainer is a first brush retainer, and the continuous retaining loop is a first continuous retaining loop;

the cosmetics brush holder comprises a second brush retainer cooperating with the outer sidewall surface to define a second continuous retaining loop; and an area of the first continuous retainer loop is greater than an area of the second continuous retainer loop.

20. The cosmetics brush holder of claim 12, wherein:

the brush retainer is a retaining clip comprising a clip portion, a mounting portion, and a mounting slot;

the mounting portion at least partially defines the mounting slot;

an upper sidewall edge of the holder sidewall is received in the mounting slot; and the clip portion extends outward and away from the outer sidewall surface and defines a handle channel configured to receive a handle of the second cosmetics brush.

21. The cosmetics brush holder of claim 20, wherein the retaining clip is selectively removable from the holder body.

* * * * *